United States Patent [19]

Linsmeyer et al.

[11] Patent Number: 5,009,378

[45] Date of Patent: Apr. 23, 1991

[54] RAKE MATE AND METHODS OF CONSTRUCTING AND UTILIZING SAME

[76] Inventors: John C. Linsmeyer; Greg Linsmeyer, both of P.O. Box 195, Quinnesec, Mich. 49876

[21] Appl. No.: 460,731

[22] Filed: Jan. 4, 1990

[51] Int. Cl.[5] ..... B65B 67/04

[52] U.S. Cl. ..... 248/99; 294/60

[58] Field of Search ..... 248/99, 95, 97, 100, 248/101, 500, 506, 507; 294/60, 1.4, 1.1; 15/257.8, 257.1

[56] References Cited

U.S. PATENT DOCUMENTS

| | | | |
|---|---|---|---|
| 1,659,461 | 2/1928 | Curran | 15/257.8 UX |
| 3,506,296 | 4/1970 | Nelson | 294/60 X |
| 3,998,415 | 12/1976 | D'Antonio et al. | 15/257.1 X |
| 4,615,743 | 10/1986 | Bylenga | 248/99 X |
| 4,738,478 | 4/1988 | Bean, Jr. | 248/99 X |
| 4,759,519 | 7/1988 | Cheng | 248/99 |
| 4,768,742 | 9/1988 | Kaaloa | 248/99 |
| 4,775,123 | 10/1988 | Borland et al. | 248/99 |
| 4,805,858 | 2/1989 | Taylor | 248/79 |
| 4,832,291 | 5/1989 | Nelson et al. | 248/99 |
| 4,832,292 | 5/1989 | Beckham | 248/99 |

*Primary Examiner*—Ramon O. Ramirez

*Attorney, Agent, or Firm*—Irving M. Weiner; Robert M. Petrik; Joseph P. Carrier

[57] ABSTRACT

A device for holding refuse bags in an open position, the device including a handle and footpad. The handle provides a "dustpan" feature which permits the device to be easily moved about the yard area. The footpad steadies the device while refuse is being inserted into the bag. The device may also be suspended by the handle to resemble a garbage can.

12 Claims, 1 Drawing Sheet

RAKE MATE AND METHODS OF CONSTRUCTING AND UTILIZING SAME

BACKGROUND OF THE INVENTION

The present invention relates to the art of placing lawn debris and other trash in bags. More specifically, the invention relates to a device for holding and supporting a plastic bag in an open position which may be used in the yard or garage. In addition, the device eliminates the need for stooping and lifting debris by providing an open mouth of the bag at ground level. The device may be easily moved about by using a handle provided thereon. A support device is also provided to steady the device while debris is being deposited in the bag.

DESCRIPTION OF THE RELEVANT ART

Heretofore, there have been various means for holding plastic bags in an open position. These have not been entirely satisfactory in the securement of the bag to the device and in the stability of the device.

U.S. Pat. No. 4,805,858 discloses a frame device adapted to hold a refuse bag in an open position. The refuse bag is held on the frame by a cord. The frame includes a channel into which the cord is received. One side of the frame includes a stake to enable the frame to be anchored and support the frame in a vertical position. The vertical frame then permits refuse or lawn debris to be raked into the bag.

This device has several shortcomings. It is difficult to move about the area to be cleaned, requires the stake to be inserted into the ground and does not provide a handle for carrying.

U.S. Pat. No. 4,615,743 discloses a U-shaped tubular frame which is flexible to adjust to variations in bag size. The bag is held on the frame by friction which may be enhanced by providing particulate matter such as sand on the frame. This frame appears to be unstable and not readily moveable from sight to sight.

U.S. Pat. No. 4,775,123 discloses a frame for supporting a bag in a manner such that refuse may be swept in or dropped in. The device includes a wall mounted bracket for hanging the bag in a vertical position. The frame includes an improved manner of attaching the bag to the frame including pulling a "tail" of the bag through a finger hold and securing the tail in a notch.

This device does not appear to be stable and does not include a handle.

The present invention provides a stable frame member to which a bag may be quickly attached, can be easily moved and maybe mounted to a wall.

SUMMARY OF THE INVENTION

The present invention provides an improved bag holding device which is portable and easily and securely holds the bag on the frame.

In a preferred embodiment, the frame is provided in a generally D-shaped configuration with a straight portion adapted to be the support base. An elastic band is attached to the frame and securely attaches the mouth of the bag to the frame. A handle is provided so that the frame and bag may be easily moved about. Finally, a foot support is provided which holds the frame steady while raking material into the bag.

It is an object of the present invention to provide a novel bag holding apparatus which is simple and affective.

It is a further object of the present invention to provide a stable frame member which holds the bag mouth open.

It is a further object of the present invention to provide an apparatus which does not have the tendency to have the bag dislodged during normal use.

It is a still further object of the present invention to provide an apparatus which is portable and securable to a wall.

The above and further objects, details and advantages of the invention will become apparent from the following detailed description, when read in conjunction with the accompanying drawings.

DETAILED DESCRIPTION OF THE PREFERRED EMBODIMENTS

Figure 1:
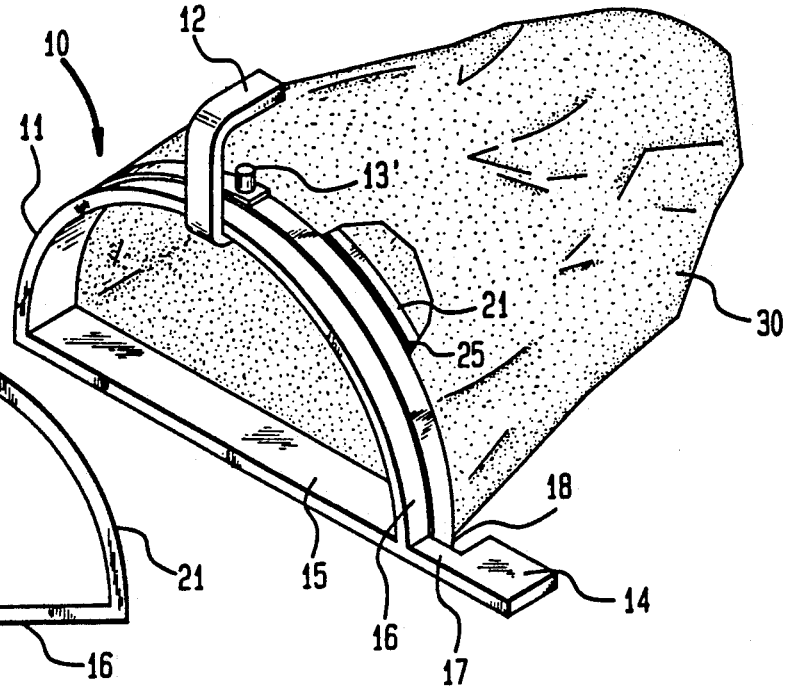
FIG. 1 illustrates a perspective view of a bag holding apparatus with a bag thereon in accordance with the present invention.

As shown in FIG. 1, the bag holding apparatus is designated generally by the numeral 10. The apparatus is designed to accommodate 33 gallon or larger bags and includes a generally D-shaped frame member 11, a handle 12, an elastic strap 13, an attachment means 13' and a footpad 14.

The frame member 11 includes a base 15 and upper rounded portion 16. The base 15 is of a sufficient width such that the apparatus 10 will stand without outside support. Base 15 may optionally include a beveled edge or be curved downwardly to make loading of the bag easier. Footpad 14 is provided to permit a user of the apparatus a means to secure the frame 11 in place while refuse or debris is being inserted or raked through the frame into a bag 30. Pad 14 is offset from the base 15 by extension 17 which includes cut-out 18 to permit passage of strap 13 around the apparatus.

Handle 12 is attached to the forward side of the frame 11 with a rearwardly extending grasping portion.

Figure 5:
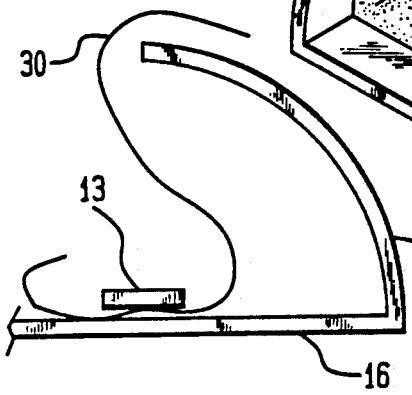
FIG. 5 illustrates the relationship between the strap, rim and bag.
Figure 2:
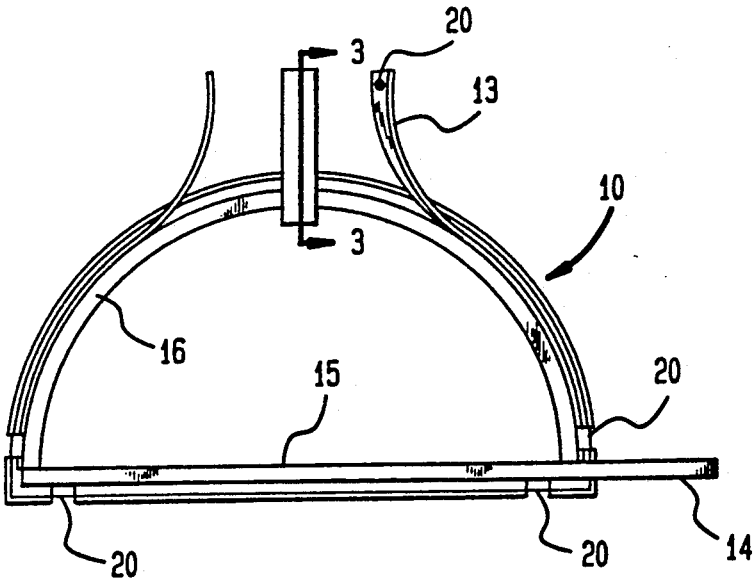
FIG. 2 illustrates a front view of a bag holding apparatus in accordance with the present invention.
Figure 3:
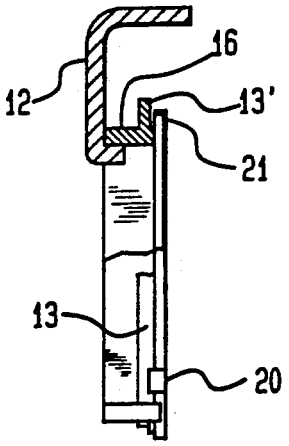
FIG. 3 illustrates a cross-section view taken along line 3—3 of FIG. 2.
Figure 4:
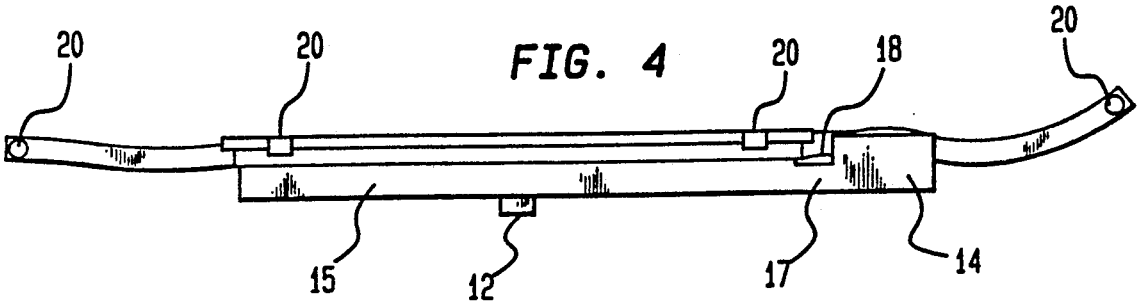
FIG. 4 illustrates a bottom view of a bag holding apparatus in accordance with the present invention.

As best seen in FIG. 5, the rear side of the frame 11 includes a rolled or curled rim 21 and forms a channel. Rim 21 engages with the bag mouth and cooperates with strap 13 to secure the bag to the frame. Rim 21 also provides a means for securing strap 13 to the frame. Portions 20 comprise strap securement means and show where the rim 21 has been further bent to "pinch" and thus secure strap 13 between the rim 21 and frame 11. The strap securement means may comprise other well known means for securing a strap such as rivets, etc.

Strap 13 is preferably a one piece elastic strap with reinforced holes 20 at each end. The strap 13 is of sufficient length such that each end may be attached at means 13' and extend around the upper member 16 and base 15. The strap 13, when fully extended and fastened at means 13', acts to secure the mouth of bag 30 to apparatus 10. The ends of strap 13 are secured to means 13' by placing means 13' in the holes 20.

The handle 12 provides the apparatus 10 with the capability of being easily moved about. This "dustpan feature" permits the apparatus to be used in a manner similar to a person using a broom and dustpan. Handle 12 may also be employed to fasten the apparatus to extend outwardly from a wall (not shown). A bracket or eye hook adapted to receive handle 12 would be mounted to a wall at a height to permit the bag 30 to reach the ground.

Footpad 14 provides a means for holding the apparatus steady without using the handle 12. In use, after the apparatus has been moved to the desired location, a user would place a foot on pad 14 while sweeping or raking material into the bag 30. Even though frame 11 is designed to be stable and stand upright, the act of pushing material into the apparatus may cause the apparatus to fall over. Thus, pad 14, when stood upon, is a means for stabilizing the apparatus for the insertion of material or refuse. One advantage of this type of stabilizing device is that the apparatus does not have to be modified if it is desired to hand the frame from a bracket mounted to a wall. Preferably, the user places their toes against the frame 11 while raking material into the device.

As best seen in FIG. 5, the bag 30 is secured to the apparatus 10, and more specifically, to upper curve member 16, by placing the mouth of the bag 30 over the rim 21 and attaching strap 13 to means 13'. The bag 30 is thus secured by the strap 13 which provides a clamping force. In addition, strap 13 naturally fits beneath rim 21 into the channel and thus forcing bag 30 beneath rim 21 forming crease 25 in bag 30. The ends of the bag 30 may be folded over strap 13. Portions 20 prevent bag 30 from being secured beneath strap 13 under the base 15 and at the lower portions of upper member 16. However, the mouth of the bag is frictionally held onto the frame at these portions of the device.

The invention is characterized by extreme simplicity, economy of manufacturing, durability and convenience of use. Its uncomplicated nature and ready attachability and removal of a refuse bag renders the invention practical where much of the known prior art has proven to be impractical.

Although there has been described what is at present considered to be preferred embodiments of the invention, it will be understood that various modifications and variations maybe made therein, and it is intended to cover in the appended claims all such modifications as fall within the true spirit and scope of the invention.

We claim:

1. An apparatus for removably securing a bag mouth in an open position, comprising:

a frame member including a base adapted to support said apparatus, said frame having a rolled rim which secures a strap to said frame and cooperates with said strap to secure a bag to said apparatus;

a semi-circular portion of said frame contiguous with said base;

a handle attached to said semi-circular portion;

bag attachment means comprising a strap extending along a rear portion of the bottom of said base upwardly such that the ends of said strap meet adjacent said handle; and a foot pad extension extending from said base outward from said semi-circular portion, said boot pad accommodating a user's foot securely hold said apparatus while inserting material through said apparatus into said bag, said foot pad extension includes a cut-out portion to accommodate the passage of said strap about said frame.

2. The apparatus of claim 1, wherein:

said strap includes an aperture at each end; and said strap is such a length that it is taught when said apertures are secured on a strap attachment means.

3. The apparatus of claim 2, wherein:

said strap captures said bag mouth between said rolled rim and said semi-circular portion.

4. The apparatus of claim 3, wherein:

said bag mouth is placed over said rim and said apertures and said strap secured to said strap attachment means to secure said bag to said apparatus.

5. The apparatus of claim 4, wherein:

said handle provides a means for easily moving said apparatus about the area desired to be cleaned.

6. The apparatus of claim 5, wherein:

said apparatus is used to capture leaves and other refuse.

7. The apparatus of claim 6, wherein:

a forward portion of said base includes a downwardly curved portion to aid in the passage of refuse through said apparatus into said bag.

8. An apparatus for holding a bag in an open position such that materials may be inserted through said apparatus and into said bag while said apparatus is supporting the bag in a horizontal orientation; comprising:

a frame including a base and bag attachment portion, a rear portion of said frame having a rolled rim;

a rearwardly extending handle member secured to said frame;

said bag secured to said frame by placing the mouth of said bag about said frame over said rim;

an elastic strap extending around said frame for securing said bag, said strap secured to the underside of said base at each end thereof by said rim clamping said strap;

a first end of said strap passing upwardly about said bag attachment portion at one end of said base; and a foot pad extending from said frame to steady and hold upright said apparatus while refuse is raked through said frame into said bag, a second end of said strap passing through a cut-out portion adjacent said foot pad.

9. The apparatus of claim 8, wherein:

said base and said bag attachment portion form a substantially D-shaped frame.

10. The apparatus of claim 9, wherein:

said apparatus accommodates 33 gallon or larger bags.

11. The apparatus of claim 10, wherein:

said base includes a beveled forward edge.

12. A bag securement device, including:

a frame comprising a base, a foot pad and an upper portion;

said foot pad extends from a first end of said base for supporting said frame in an upright position;

said frame including a handle attached thereto;

a bag securement means extending about said frame; and a cut-out portion in said foot pad to accommodate the passage of said bag securement means.

* * * * *